US008032066B2

(12) United States Patent
Kim

(10) Patent No.: US 8,032,066 B2
(45) Date of Patent: Oct. 4, 2011

(54) SYSTEM AND METHOD FOR CORRECTING COLOR REGISTRATION

(75) Inventor: Jin-il Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 130 days.

(21) Appl. No.: 11/450,290

(22) Filed: Jun. 12, 2006

(65) Prior Publication Data

US 2007/0003332 A1 Jan. 4, 2007

(30) Foreign Application Priority Data

Jun. 29, 2005 (KR) ..... 10-2005-0056861

(51) Int. Cl.
*G03G 15/01* (2006.01)

(52) U.S. Cl. ..... 399/301

(58) Field of Classification Search ..... 399/298, 399/299, 301

See application file for complete search history.

(56) References Cited

U.S. PATENT DOCUMENTS 6,377,758 B1 * 4/2002 OuYang et al. ..... 399/15
6,701,096 B2 * 3/2004 Arai et al. ..... 399/12
2004/0253013 A1 * 12/2004 Furukawa ..... 399/49
2005/0083530 A1 * 4/2005 Ogihara et al. ..... 356/446
2006/0177246 A1 * 8/2006 Kawada et al. ..... 399/301

FOREIGN PATENT DOCUMENTS

JP 08-085235 4/1996
JP 2000-181171 6/2000
JP 2003195604 A * 7/2003
JP 2004-117403 4/2004
JP 2004-125827 4/2004
JP 2004-294471 10/2004

OTHER PUBLICATIONS

Machine translation of JP 2003-195604.*

* cited by examiner

*Primary Examiner* — David Gray
*Assistant Examiner* — Andrew Do
(74) *Attorney, Agent, or Firm* — Roylance, Abrams, Berdo & Goodman, LLP

(57) ABSTRACT

A method and apparatus for correcting a color registration are provided for improving the quality of images of an image forming apparatus. A surface condition is estimated of an intermediate transfer belt used to correct a color registration. A determination is made as to whether an abnormal section exists on the intermediate transfer belt. Location information is stored regarding the abnormal section on the intermediate transfer belt, if the abnormal section exists. A mark for color registration correction is formed on a normal section, other than the abnormal section. The color registration is corrected using the mark. Accordingly, if a partially inferior section appears in the intermediate transfer belt and a mark is not normally formed, the color registration is successfully corrected.

7 Claims, 3 Drawing Sheets

SYSTEM AND METHOD FOR CORRECTING COLOR REGISTRATION

CROSS REFERENCE TO RELATED APPLICATION

This application claims the benefit under 35 U.S.C. §119 (a) of Korean Patent Application No. 2005-56861, filed on Jun. 29, 2005, in the Korean Intellectual Property Office, the entire disclosure of which is hereby incorporated by reference.

BACKGROUND OF THE INVENTION

1. Field of the Invention

The present invention relates to an image forming apparatus and method for correcting a color registration. More particularly, the present invention relates to an image forming apparatus and method for correcting a color registration according to an intermediate transfer belt condition.

2. Description of the Related Art

Electrophotographic printers such as color laser printers comprise four color photoconductive drums Dy, Dc, Dm, and Dk corresponding to four colors, such as, yellow, cyan, magenta, and black, respectively. A laser scan unit scans the four photoconductive drums Dy, Dc, Dm, and Dk with laser beams to form desired electrostatic latent images. A developing unit develops the electrostatic latent images using color developers. A transfer belt transfers a completed color image, which is obtained by overlapping the images developed on the photoconductive drums Dy, Dc, Dm, and Dk with one another to paper.

A single color image may be obtained by developing color images formed on the four photoconductive drums Dy, Dc, Dm, and Dk using color developers, overlapping the color images at the same position of the transfer belt, and transferring a completed color image to paper.

In order to accurately overlap the four-color images at the same position of the transfer belt and obtain a desired color image, four colors have to match in a transfer beginning position and a transfer ending position. If the images formed on the four photoconductive drums Dy, Dc, Dm, and Dk are all vividly developed, but are out of registration when being transferred to the transfer belt, a clear color image cannot be obtained.

Therefore, it is important to take into account a travel velocity of the transfer belt and match points of scanning time when the photoconductive drums Dy, Dc, Dm, and Dk are exposed to laser beams by the laser scan unit. The scanning time matching to overlap a plurality of color images accurately is referred to as "color registration".

If the scanning times are matched according to an initially set value, an error may still occur in the color registration as a printing operation progresses. The error occurring in the color registration may be caused by various reasons such as an error caused by inaccurate arrangements of a color developing unit, error occurring in the manufacturing of an optical lens, and error occurring in the driven transfer belt. Additional errors may occur if the printer has a serial structure composed of a plurality of developing units.

FIG. 1 is a view illustrating a system that adopts a conventional method for correcting color registration. Referring to FIG. 1, the system comprises a color registration sensor 10, intermediate transfer belt 20, controller 30, and laser scan unit 40.

The color registration sensor 10 comprises a light emitting unit 13 and a light receiving unit 17. The light emitting unit 13 emits a constant level of light toward the intermediate transfer belt 20. The light receiving unit 17 detects a reflection pattern of light reflected from the intermediate transfer belt 20.

The intermediate transfer belt 20 has a certain mark that is formed by the laser scanning unit 40, which is necessary to correct a color registration. The controller 30 receives the reflection pattern from the light receiving unit 17 and corrects the color registration based on the reflection pattern.

The laser scan unit 40 irradiates laser beams and selectively exposes charged photoconductive media to laser beams, thereby forming electrostatic latent images on surfaces of the photoconductive media, and simultaneously forms a certain mark on the intermediate transfer belt 20 by scanning the intermediate transfer belt 20.

FIG. 2 is a flowchart illustrating a conventional method for correcting a color registration. Referring to FIGS. 1 and 2, the laser scan unit 40 forms a certain mark on the intermediate transfer belt 20 that is required to correct a color registration at operation S200. The certain mark may use various types of patterns including a total reflection or irregular reflection pattern.

Next, the light emitting unit 13 of the color registration sensor 10 emits light toward the intermediate transfer belt 20 at operation S210. The light receiving unit 17 of the color registration sensor 10 detects a reflection pattern. The reflection pattern is estimated as a voltage level by the light receiving unit 17 at operation S220.

The light receiving unit 17 transmits the estimated voltage level to the controller 30 and the controller 30 determines whether it is possible to correct a color registration based on the transmitted control level (voltage level) at operation S230.

If it is possible to correct a color registration, the controller 30 stores location information regarding the mark formed on the intermediate transfer belt 20 based on the voltage level at operation S240. According to the location information, an X offset, Y offset, width error, and skew are calculated.

The X offset indicates an error occurring in a direction of scanning, which is a direction where the color registration sensor 10 scans. The Y offset indicates an error occurring in a direction where the intermediate transfer belt 20 advances. The width error indicates an error occurring due to a difference between horizontal widths in an image area, and the skew indicates an error occurring due to tilted scanning lines.

The controller 30 corrects the color registration based on the above calculated data at operation S260. The controller 30 also controls the scanning times of the laser scan unit 40 based on the corrected color registration and performs a printing operation at operation S270.

However, if the intermediate transfer belt 20 has an uneven surface or a partially abnormal section appears due to the change in the surface of the intermediate transfer belt 20, it is impossible to correct the color registration accurately.

That is, according to the conventional method for correcting the color registration, the color registration is corrected regardless of the surface condition of the intermediate transfer belt 20. Since the color registration is corrected, print positions of respective color images are not accurately controlled due to the problem of the intermediate transfer belt surface. Accordingly, quality of images printed on paper deteriorates.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide an image forming apparatus and method for correcting a color registration according to a condition of an intermediate transfer belt. The above aspect is achieved by providing a method for correcting a color registration including estimating a surface condition of an intermediate transfer belt used to correct a color registration. A determination is made as to whether an abnormal section exists on the intermediate transfer belt. Location information is stored regarding the abnormal section on the intermediate transfer belt, if the abnormal section exists. A mark is formed for color registration correction on a normal section other than the abnormal section. The color registration using the mark is corrected.

In an exemplary implementation, a determination is made as to whether the mark for color registration correction can be formed on the normal section. The mark on the normal section is formed, if the mark can be formed. The mark is formed on a specific section of the intermediate transfer belt and the color registration is corrected, if an abnormal section does not exist on the intermediate transfer belt. If the mark can not be formed on the normal section, the mark is not formed.

In another exemplary implementation, information indicating the impossibility of correcting the color registration is displayed.

In a further exemplary implementation, the estimating of the surface condition of the intermediate transfer belt is performed by detecting a voltage level of a reflection pattern of light that is reflected from a surface of the intermediate transfer belt, after being emitted toward the intermediate transfer belt.

In another exemplary implementation, the determining of whether an abnormal section exists is performed based on a difference between an offset voltage level at the surface of the intermediate transfer belt and the detected voltage level.

In another exemplary implementation, the storing of the location information is performed by a storage device of a controller that performs the operation of correcting the color registration.

In still another exemplary implementation, the determining of whether the mark can be formed on the normal section is performed based on determining whether a total length of the normal section exceeds a minimum length that is required to correct the color registration.

In an exemplary implementation, the mark is formed by a scanning operation of a laser scan unit.

In another exemplary implementation, a printing operation is performed according to the corrected color registration.

The above aspect of an exemplary embodiment is achieved by providing an apparatus for correcting a color registration including a color registration sensor that estimates a surface condition of an intermediate transfer belt used to correct a color registration. A controller determines whether an abnormal section exists on the intermediate transfer belt. Location information is stored regarding the abnormal section on the intermediate transfer belt, if the abnormal section exists. A mark for color registration correction is formed on a normal section, other than the abnormal section. The color registration using the mark is corrected.

In an exemplary implementation, the controller determines whether the mark for color registration correction can be formed on the normal section. The mark is formed on the normal section if the mark can be formed. The mark is formed on a specific section of the intermediate transfer belt and the color registration is corrected if an abnormal section exists on the intermediate transfer belt. If the mark can not be formed on the normal section, the controller does not form the mark.

In another exemplary implementation, the apparatus further includes a display that displays information indicating the impossibility of correcting the color registration.

In a further exemplary implementation, the estimating of the surface condition of the intermediate transfer belt is performed by detecting a voltage level of a reflection pattern of light that is reflected from a surface of the intermediate transfer belt, after being emitted toward the intermediate transfer belt.

In an exemplary implementation, the controller determines whether an abnormal section exists, based on a difference between an offset voltage level at the surface of the intermediate transfer belt and the detected voltage level.

In another exemplary implementation, the controller includes a storage device that stores the location information regarding the abnormal section on the intermediate transfer belt.

In still another exemplary implementation, the controller determines whether the mark can be formed on the normal section by determining whether a total length of the normal section exceeds a minimum length that is required to correct the color registration.

In an exemplary implementation, the apparatus further includes a laser scan unit to form the mark.

In another exemplary implementation, the controller performs a printing operation according to the corrected color registration.

The above aspect of an exemplary embodiment of the present invention is also achieved by providing an image forming apparatus having an apparatus for correcting a color registration which matches laser points of scanning time of different color units to overlap a plurality of developed color images on an accurate location of an intermediate transfer belt and thereby achieve a desired color image. The apparatus for correcting a color registration and thereby achieve a desired color image. The apparatus for correcting a color registration includes a color registration sensor that estimates a surface condition of the intermediate transfer belt used to correct a color registration. A controller determines whether an abnormal section exists on the intermediate transfer belt. Location information is stored regarding the abnormal section on the intermediate transfer belt if the abnormal section exists. A mark for color registration correction is formed on a normal section, other than the abnormal section. The color registration using the predetermined mark is corrected.

In an exemplary implementation, the controller determines whether the mark can be formed for color registration correction on the normal section. The mark is formed on the normal section if the mark can be formed.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

Figure 1:
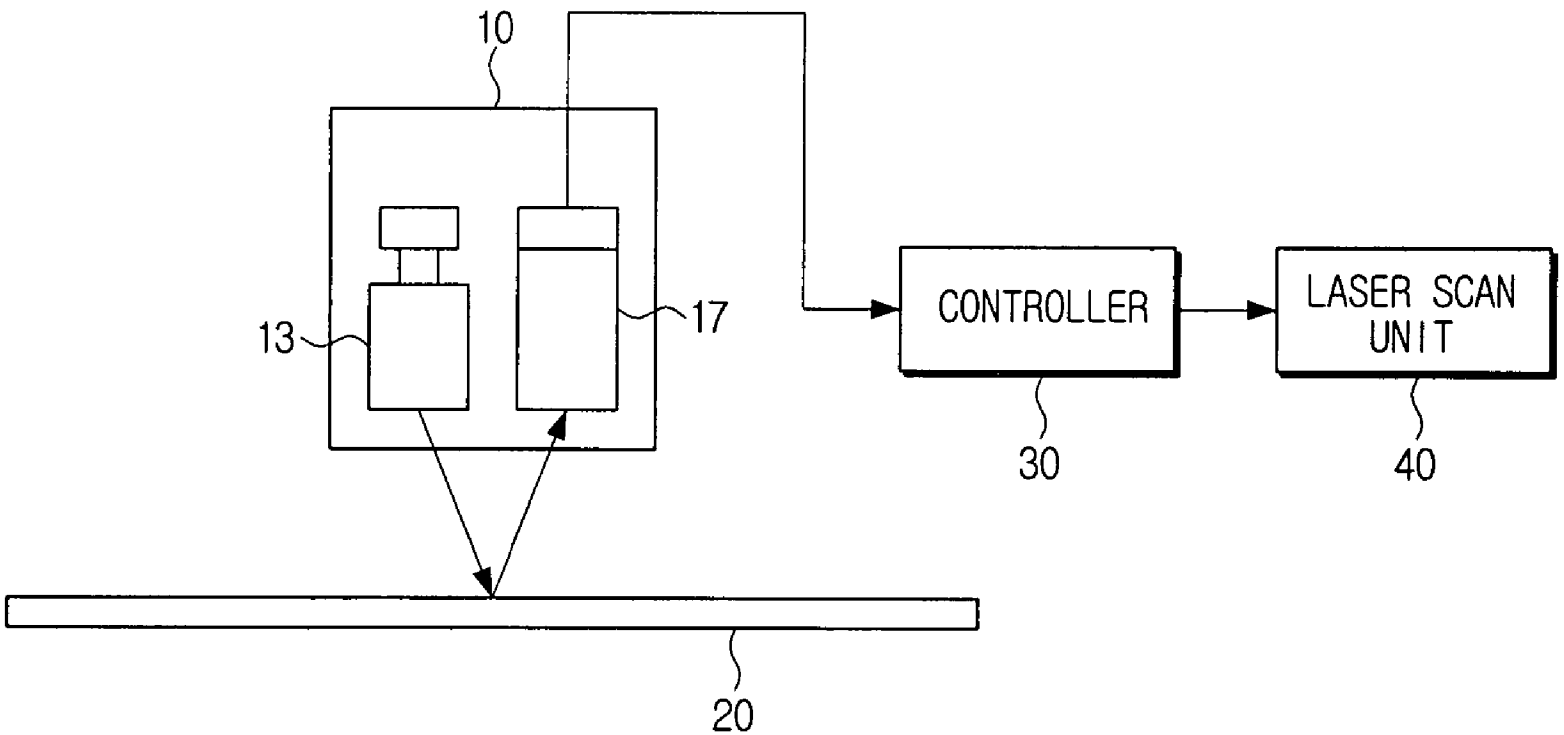
FIG. 1 (CONVENTIONAL ART)
FIG. 1 is a view illustrating a system that adopts a conventional method for correcting a color registration.
Figure 3:
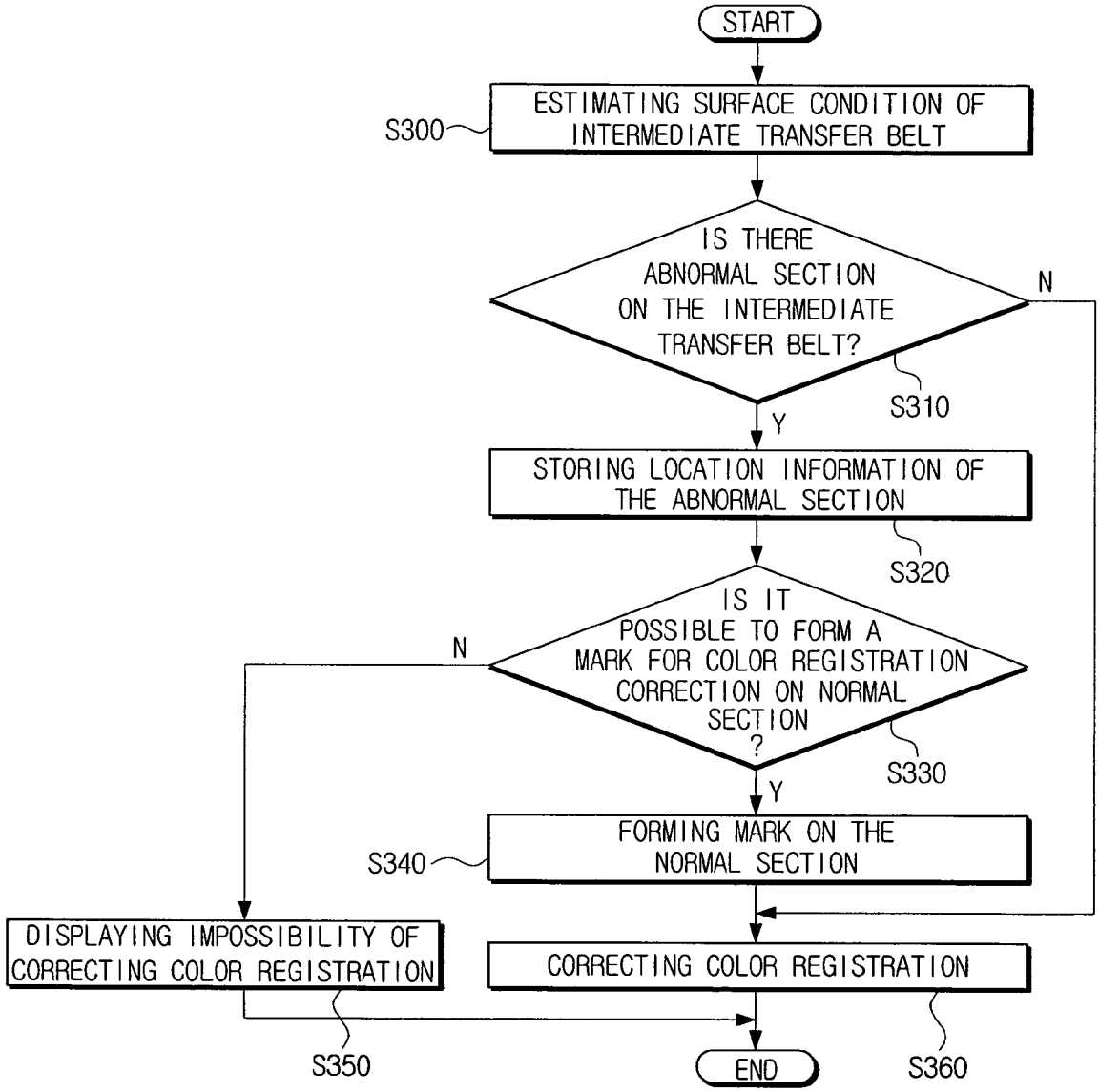
FIG. 3 is a flowchart illustrating a method for correcting a color registration according to an exemplary embodiment of the present invention.

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness FIG. 3 is a flowchart illustrating a method for correcting a color registration according to an exemplary embodiment of the present invention. Hereinafter, a method for correcting a color registration according to an exemplary embodiment of the present invention will now be described in detail with reference to FIGS. 1 and 3.

The color registration sensor 10 estimates a condition of the surface of the intermediate transfer belt 20 at operation S300. For example, the light emitting unit 13 of the color registration sensor 10 emits light toward the intermediate transfer belt 20 according to a command from the controller 30. At this time, a mark is not formed on the intermediate transfer belt 20 and a reflection pattern of the surface of the intermediate transfer belt 20 is detected by the light receiving unit 17 of the color registration sensor 10. A voltage level of the reflection pattern detected by the light receiving unit 17 is transmitted to the controller 30.

The controller 30 determines whether an abnormal section exists on the surface of the intermediate transfer belt at operation S310. For example, the controller 30 compares a voltage level A of the reflection pattern occurring in the surface of the intermediate transfer belt 20 with an offset voltage level B that is pre-stored in the controller 30 and naturally occurs in the surface of the intermediate transfer belt 20 for each section of the transfer belt 20. The controller 30 determines whether an abnormal section exists on the intermediate transfer belt 20 based on a result of comparison. If a certain section has a difference between the voltage levels A and B exceeding a threshold, the controller 30 determines that an abnormal section exists on the surface of the transfer belt 20.

Figure 2:
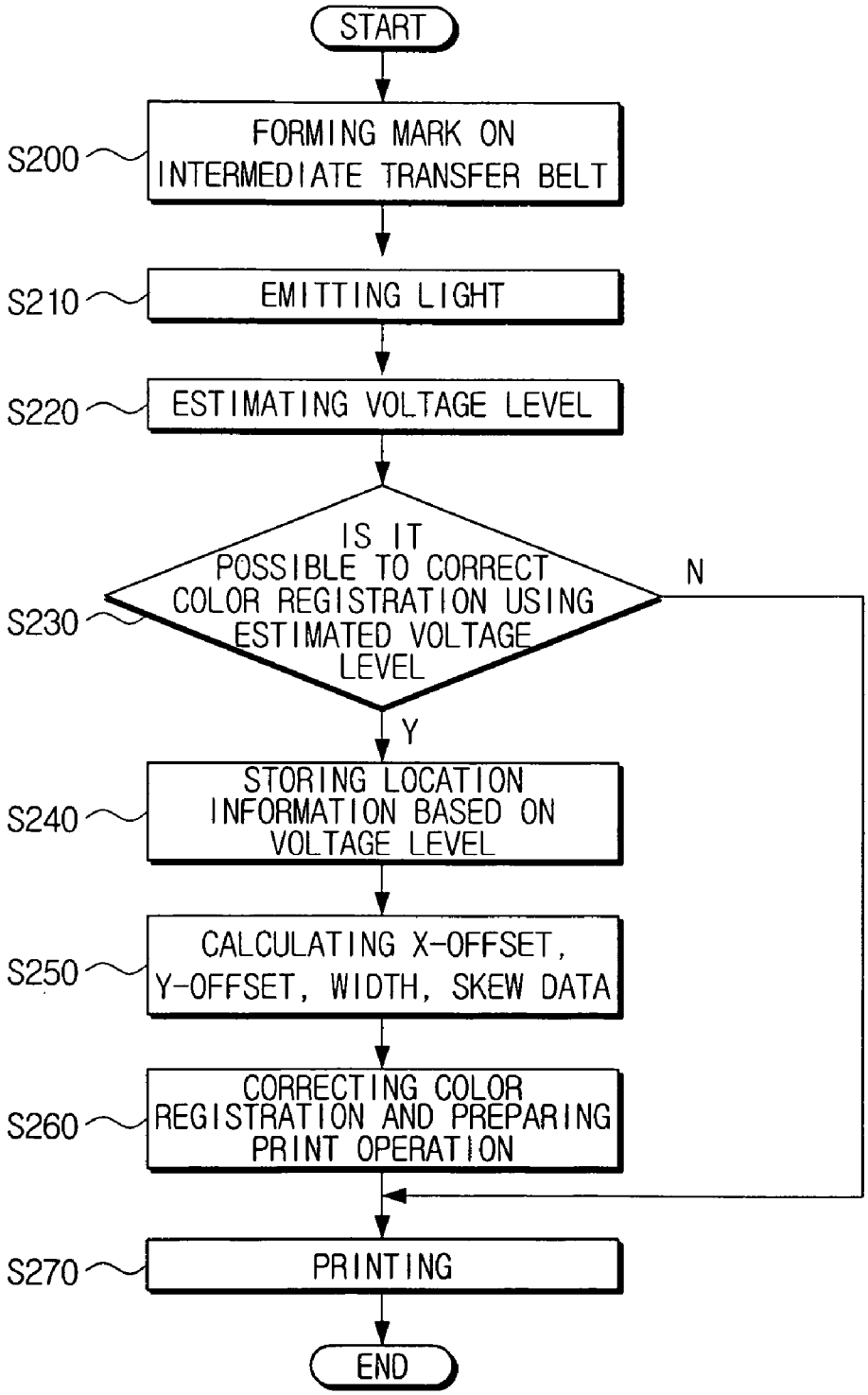
FIG. 2 (CONVENTIONAL ART)
FIG. 2 is a flowchart illustrating a conventional method for correcting a color registration.

If a section does not have a difference between the voltage levels A and B exceeding the threshold, the controller 30 corrects the color registration according to the conventional method described with reference to FIG. 2.

At operation S320, if a section has a difference between the voltage levels A and B exceeding the threshold, the controller 30 stores in its storage device (not shown) location information regarding where the abnormal section is located, which is determined at operation S310. Accordingly, the location information of the abnormal section is stored in, for example, an EEPROM.

Next, the controller 30 determines whether a mark for color registration correction can be formed on a normal section of the intermediate transfer belt 20, other than the abnormal section at operation S330.

For example, a determination is made as to whether the total length of the normal section, other than the abnormal section, exceeds the minimum length that is required to form a predetermined mark necessary to correct the color registration.

The minimum length of normal section that is required to form a predetermined mark necessary to correct a color registration is set at the time of manufacturing the image forming apparatus or by a user, depending on a working environment of the image forming apparatus according to an exemplary embodiment of the present invention.

If the abnormal section continuously and repeatedly occurs or has an extremely wide range, it is impossible to form a predetermined mark to correct a color registration. In this instance, the color registration fails to be corrected.

In an exemplary embodiment, there may be a plurality of normal sections on the intermediate transfer belt 20, which may be away from one another. For example, the intermediate transfer belt 20 is divided into a normal section R1, abnormal section R2, normal section R3, and abnormal section R4 in sequence. If the length of at least one of the normal sections R1 and R3 exceeds the minimum length that is required to form a mark for color registration correction, the controller 30 determines that a mark for color registration correction can be formed at operation S330.

If the controller 30 determines that a normal section does not exist on the intermediate transfer belt 20 or that a normal section is not as long as it should be to form the mark, the controller 30 displays information indicating the impossibility of correcting the color registration on a display (not shown) at operation S350. When a user notices the information displayed on the display, the user takes prompt action, for example, replaces the intermediate transfer belt 20 to make it possible to correct the color registration.

At operation S340, if a determination is made that a mark can be formed for color registration correction on a normal section of the intermediate transfer belt 20, other than the abnormal section at operation S330, the controller 30 controls a predetermined mark to be formed on a normal section, other than the abnormal section, based on the location information of the abnormal section stored in the storage device of the controller 20 at operation S320.

The predetermined mark is formed by the laser scanning device 40 under a command from the controller 30. The color registration is then corrected using the predetermined mark formed on the normal section of the intermediate transfer belt at operation S360.

For example, the predetermined mark uses various types of patterns including a total reflection or irregular reflection pattern.

Next, the light emitting unit 13 of the color registration sensor 10 emits light toward the intermediate transfer belt 20, and the light receiving emitting unit 17 of the color registration sensor 10 detects a reflection pattern of light reflected from the intermediate transfer belt 20. The reflection pattern is estimated as a voltage level by the light receiving unit 17.

The light receiving unit 17 transmits the estimated voltage level to the controller 30, and the controller determines whether the color registration can be corrected using the transmitted voltage level.

If the color registration can be corrected, the controller 30 stores location information regarding the mark formed on the intermediate transfer belt 20 based on the voltage level. According to the location information, an X offset, Y offset, width error, and skew may be calculated.

The controller 30 corrects the color registration based on the calculated data as above at operation S260, and controls the scanning times of the laser scan unit and performs a printing operation at operation S270.

According to exemplary embodiments of the present invention as described above, if a partially inferior section appears in the intermediate transfer belt 20 and a mark is not normally formed, the color registration is successfully corrected. As a result, the quality of images of the image forming apparatus may be improved.

While the invention has been shown and described with reference to certain exemplary embodiments thereof, it will be understood by those skilled in the art that various changes in form and details may be made therein without departing from the spirit and scope of the invention as defined in the appended claims.

What is claimed is:

1. An image forming apparatus capable of performing a color registration correction, the apparatus comprising:

a color registration sensor positioned in a fixed location to detect a surface condition of the transfer belt along a linear path thereof as the transfer belt is rotated in the transfer belt rotation direction; and a controller for determining, prior to forming a mark for color registration correction on the transfer belt, whether an abnormal surface condition portion exists on the transfer belt, and storing location information of the abnormal surface condition portion on the transfer belt;

wherein the abnormal surface condition portion existing on the transfer belt is determined based on a level of a reflection light detected by the color registration sensor that is reflected from a surface of the transfer belt in response to the color registration sensor emitting light toward the transfer belt, wherein, if two or more abnormal surface condition portions exist on the intermediate transfer belt along the linear path, a length of normal section between two abnormal surface condition portions is measured, wherein the controller determines whether the mark can be formed on the normal section between the two abnormal surface condition portions by determining whether the length of the normal section exceeds a length required to form the mark for the color registration correction on the transfer belt, and wherein the controller performs color registration correction by forming the mark for color registration correction on the normal section between the two abnormal surface condition portions if the length of the normal section exceeds the length required to form the mark for the color registration correction.

2. The apparatus as claimed in claim 1, wherein the mark is not formed, if the mark cannot be formed on the normal section.

3. The apparatus as claimed in claim 2, further comprising a display for displaying information comprising an indication of the impossibility of correcting the color registration.

4. The apparatus as claimed in claim 1, wherein the controller determines whether an abnormal section exists based on a difference between an offset voltage level at the surface of the transfer belt and the level of the reflection pattern detected by the color registration sensor.

5. The apparatus as claimed in claim 1, further comprising a storage device that stores the location information of the abnormal section on the transfer belt.

6. The apparatus as claimed in claim 1, wherein the mark is formed by a scanning operation of a laser scan unit.

7. The apparatus as claimed in claim 1, wherein a printing operation is performed according to the corrected color registration.

* * * * *